US010301981B2

(12) United States Patent
Verner et al.

(10) Patent No.: US 10,301,981 B2
(45) Date of Patent: May 28, 2019

(54) METHOD FOR RETRACTING A SLIDING CAMSHAFT ACTUATOR PIN

(71) Applicant: GM GLOBAL TECHNOLOGY OPERATIONS LLC, Detroit, MI (US)

(72) Inventors: Douglas R Verner, Sterling Heights, MI (US); Scot A Douglas, Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 230 days.

(21) Appl. No.: 15/475,654

(22) Filed: Mar. 31, 2017

(65) Prior Publication Data

US 2018/0283236 A1 Oct. 4, 2018

(51) Int. Cl.
*F01L 1/34* (2006.01)
*F01L 13/00* (2006.01)

(52) U.S. Cl.
CPC ... *F01L 13/0036* (2013.01); *F01L 2013/0052* (2013.01); *F01L 2013/101* (2013.01); *F01L 2101/00* (2013.01)

(58) Field of Classification Search
CPC ..... F01L 13/0063; F01L 13/0036; F01L 2009/0449; F01L 2013/101; F01L 2013/0052; F01L 2101/00
See application file for complete search history.

(56) References Cited

U.S. PATENT DOCUMENTS

2011/0088643 A1* 4/2011 Gregor ..... F01L 13/0036 123/90.11

* cited by examiner

*Primary Examiner* — Zelalem Eshete

(57) ABSTRACT

A method for retracting an extended pin of a sliding camshaft actuator wherein the actuator includes a magnetic field generating coil, a magnetic piston in connection with the extended pin operable to be actuated by the magnetic field generating coil, and a pin stop plate. The method comprises creating an air gap between the magnetic piston and the pin stop plate and reversing voltage on the magnetic field generating coil to retract the extended pin.

10 Claims, 8 Drawing Sheets

METHOD FOR RETRACTING A SLIDING CAMSHAFT ACTUATOR PIN

FIELD

The present invention generally relates to sliding camshaft actuators for variable valve lift (VVL) systems, and more particularly relates to a method for retracting an extended sliding camshaft actuator pin.

BACKGROUND

The statements in this section merely provide background information related to the present disclosure and may or may not constitute prior art.

Internal combustion engines include intake and exhaust valves that can be actuated by cam lobes of at least one camshaft. In some configurations the camshafts are constructed with sliding camshaft assemblies having multiple steps for varying the lift distance of an engine valve. For example, a two-step sliding camshaft may include a high lift cam lobe position for lifting an engine valve to a maximum distance, and a low lift cam lobe position for lifting the engine valve below the maximum lift distance.

At least one sliding camshaft actuator is fixed on an internal combustion engine for changing position between the multiple cam lobes. Particularly, at least one actuator pin of a camshaft actuator is operative to selectively engage displacement grooves configured on the periphery of camshaft barrels formed on the sliding camshaft assembly. As the camshaft assembly rotates, an actuator pin is selected to move into a displacement groove of the camshaft barrel which causes the sliding camshaft assembly to shift into a different position along the camshaft axis. When a sliding camshaft shifts position, the intake and/or exhaust valves are actuated differently in accordance with the changed cam lobe position, e.g., a sliding camshaft may move from a high lift cam lobe position to a low lift cam lobe position, which in turn will cause the engine operation to be different.

Thus, the sliding camshaft actuator is an important component in the proper operation of a VVL sliding camshaft system, particularly the actuator's pin extension into, and retraction from, the displacement grooves into the camshaft barrels. If an extended actuator pin is not retracted from a displacement groove then a subsequent shift command could result in the pin being broken off or some other damage caused to the sliding camshaft system. Thus, there is a need for a reliable means of ensuring that an extended actuator pin can be caused to fully retract to prevent damage to the sliding camshaft system.

SUMMARY

One or more exemplary embodiments address the above issue by providing a method for retracting an extended sliding camshaft actuator pin. More particularly, exemplary embodiments relate to a method for retracting an extended actuator pin of a sliding camshaft actuator wherein the sliding camshaft actuator includes a housing having a pin stop plate, a magnet attached to the actuator pin being disposed intermediate between a magnetic field generating coil and the pin stop plate, wherein the magnetic field generating coil is operable to produce a magnetic field to force the magnet toward the pin stop plate to extend the actuator pin.

The method includes creating an air gap between the magnet and the pin stop plate before producing a magnetic field to force the magnet toward the pin stop plate. Another aspect includes producing the magnetic field to force the magnet toward the pin stop plate to extend the actuator pin. And yet another aspect includes producing a reverse magnetic field to force the magnet and the extended actuator pin toward the magnetic field generating coil.

According to an aspect of an exemplary embodiment wherein creating comprises attaching a non-ferrous material layer between the magnet and the pin stop plate. And another aspect of the exemplary embodiment wherein the non-ferrous material layer is disposed on the magnet.

Yet another aspect of the exemplary embodiment wherein the non-ferrous material is disposed on the pin stop plate. Still another aspect as according to the exemplary embodiment wherein creating further comprises forming a non-ferrous material collar on the actuator pin proximal to the magnet. In accordance with other aspects of the exemplary embodiment wherein producing a reverse magnetic field comprises reversing voltage to the magnetic field generating coil.

BRIEF DESCRIPTION OF THE DRAWINGS

The present exemplary embodiments will be better understood from the description as set forth hereinafter, with reference to the accompanying drawings, in which.

DETAILED DESCRIPTION OF THE INVENTION

Figure 1:
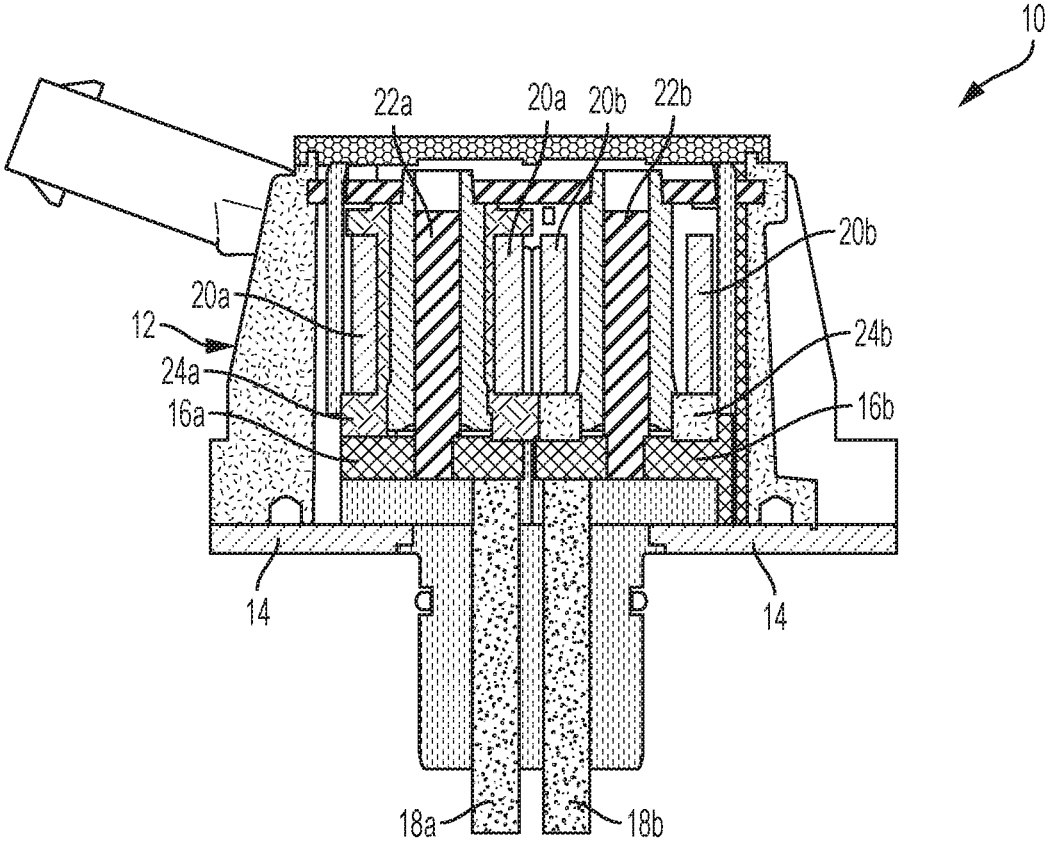
FIG. 1 is an illustration of a cross-sectional view of an unmodified sliding camshaft actuator in accordance with aspects of the exemplary embodiment.

The following description is merely exemplary in nature and is not intended to limit the present disclosure, application, or uses thereof. FIG.1 provides an illustration of a cross-sectional view of an unmodified sliding camshaft actuator 10 in accordance with aspects of the exemplary embodiment. The sliding camshaft actuator 10 includes a housing 12 having a pin stop plate which also acts to latch the magnet out 14 disposed at its base for limiting the distance an actuator pin (18*a*, 18*b*) can travel when in an extended position. The sliding camshaft actuator includes magnets (16*a*, 16*b*) attached to actuator pins (18*a*, 18*b*), respectively, that are disposed intermediate between magnetic field generating coils (20*a*, 20*b*) and the pin stop plate 14. The magnets (16*a*, 16*b*) are also mechanically attached to extension armatures (22*a*, 22*b*) operative to be repelled and retracted along the axial core of the magnetic field generating coils (20*a*, 20*b*) when the coils are energize in accordance with aspects of the exemplary embodiments. The magnetic field generating coils (20*a*, 20*b*) are wound on spools (24*a*, 24*b*), respectively, formed of ferrous or ferrous composite material that is susceptible to foster magnetic properties in the proximity of magnetic fields.

Figure 2:
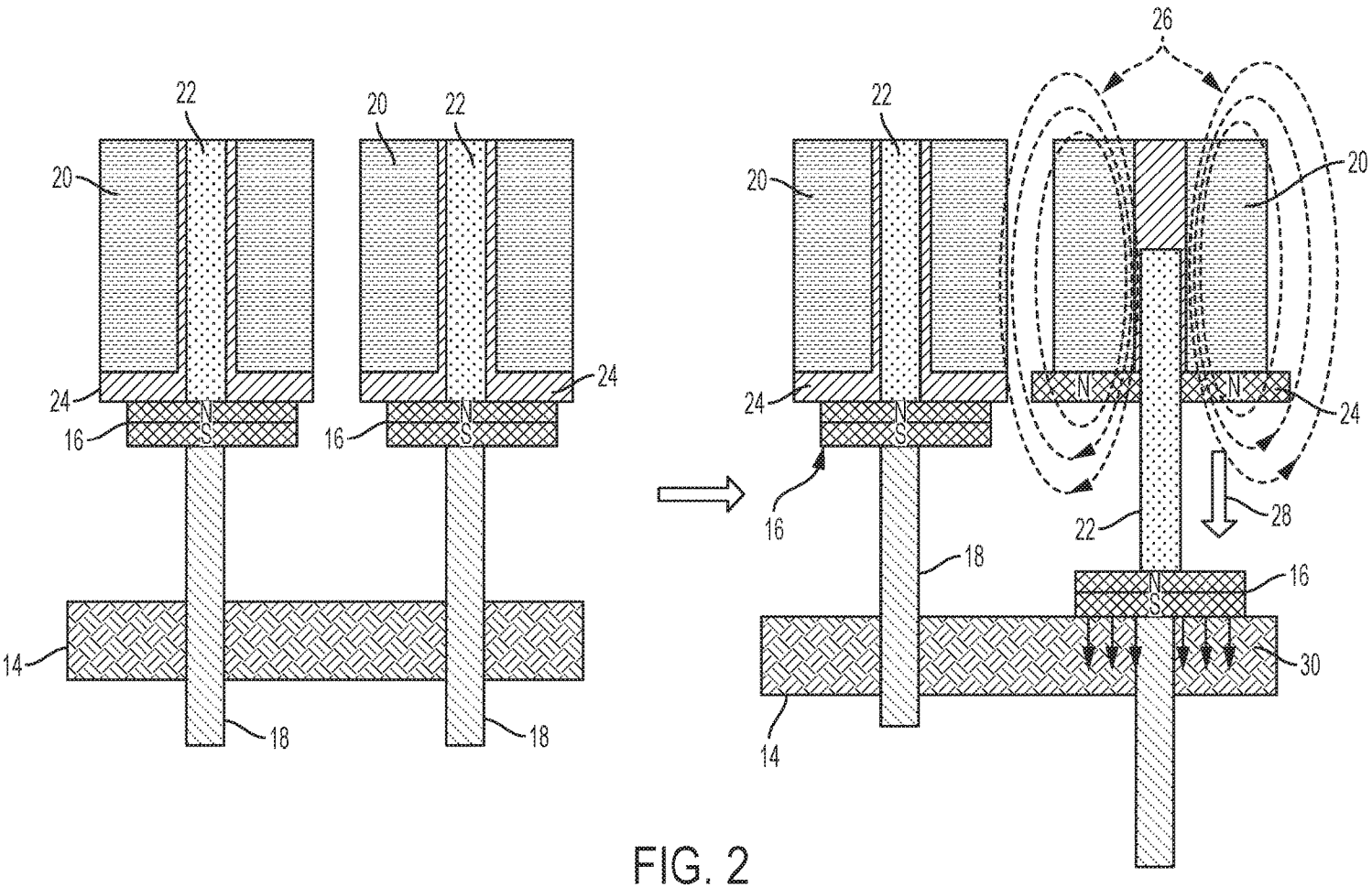
FIG. 2 is a functional illustration of a sliding camshaft actuator with a repelling magnetic field force on the magnet in accordance with aspects of an exemplary embodiment.

FIG. 2 is a functional illustration of a sliding camshaft actuator 10 with a repelling magnetic field force on the magnet 16 in accordance with aspects of an exemplary embodiment. When the magnetic field generating coils 20 are not energized the magnets 16 are in magnetic contact with the spools 24 such that the actuator pins 18 are in a retracted position. When a magnetic field generating coil 20 is energized, a magnetic field 26 is created that repels the magnet 16 in a force direction 28 until the magnet 16 comes into magnetic contact with the pin stop plate 14. In accordance with the exemplary embodiment, the pin stop plate 14 is formed of a ferrous or ferrous composite material such that magnetic attraction 30 with the magnet 16 is strong which would require a significant amount of counter-force to overcome this magnetic attraction.

Figure 3:
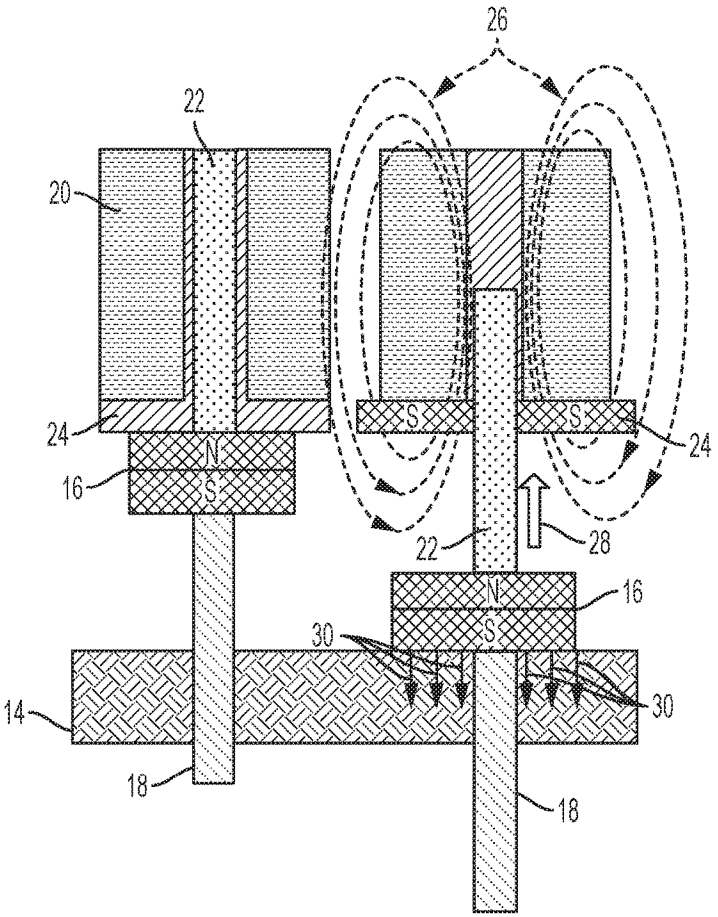
FIG. 3 is a functional illustration of a sliding camshaft actuator with an retracting magnetic field force on the magnet in accordance with aspects of an exemplary embodiment.

With reference to FIG. 3, a functional illustration of a sliding camshaft actuator 10 with a retracting magnetic field force 28 on the magnet 16 is provided. When the supply voltage to the magnetic field generating coils 20 is reversed, a reverse magnetic field 26 is created that imposes a retracting magnetic force 28 on the magnet 16. However, the retracting magnetic force 28 is not strong enough to overcome the magnetic attraction 30 between the magnet 16 and the pin stop plate 14. Therefore, the actuator pin 18 will not be retracted unless the sliding camshaft actuator 10 is removed from the engine (not shown) and manually retracted from the extended position.

Figure 4:
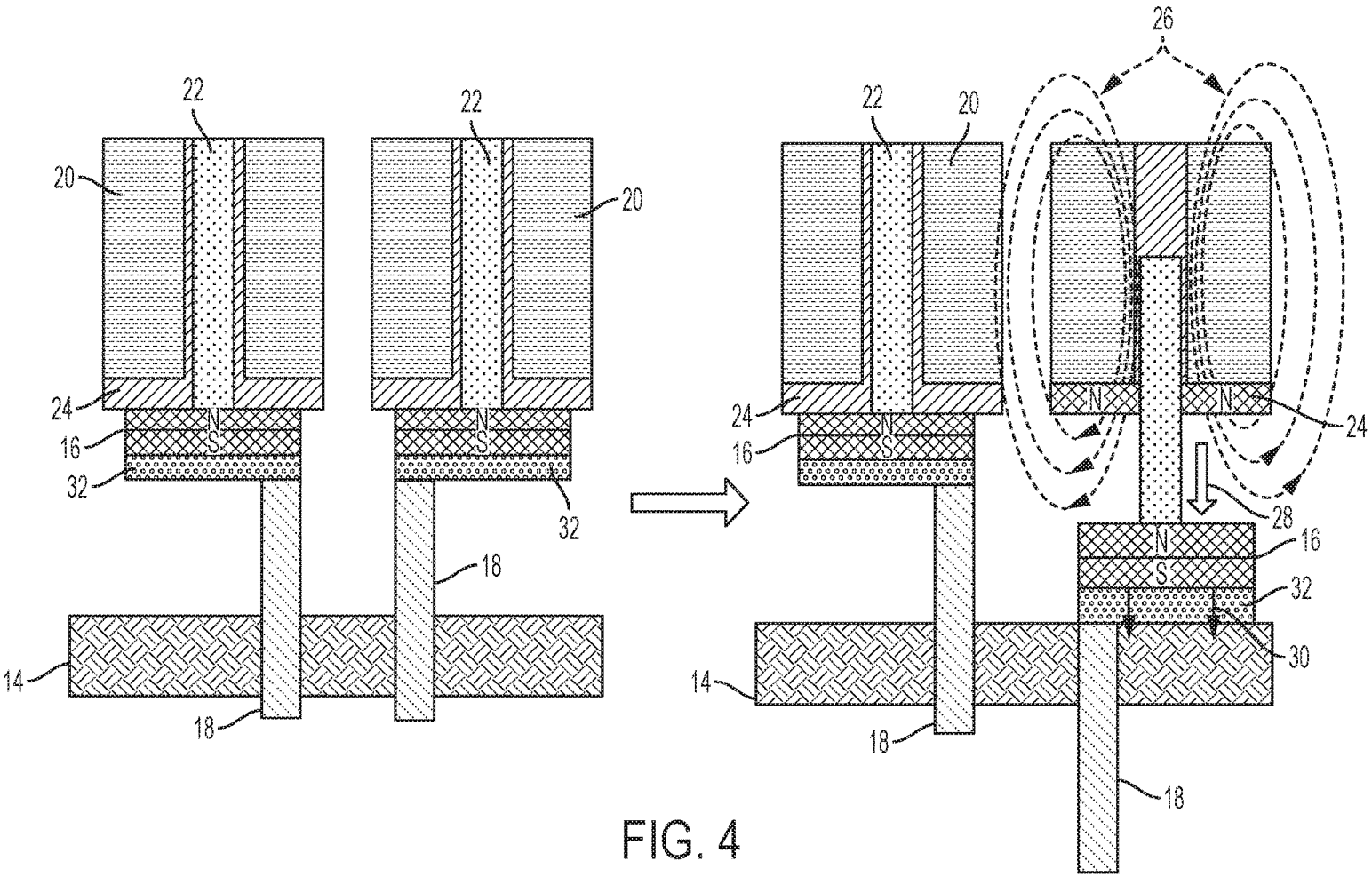
FIG. 4 is a functional illustration of a modified sliding camshaft actuator having an air gap layer disposed between the magnet and the pin stop plate being repelled by the magnetic field force in accordance with aspects of an exemplary embodiment.
Figure 5:
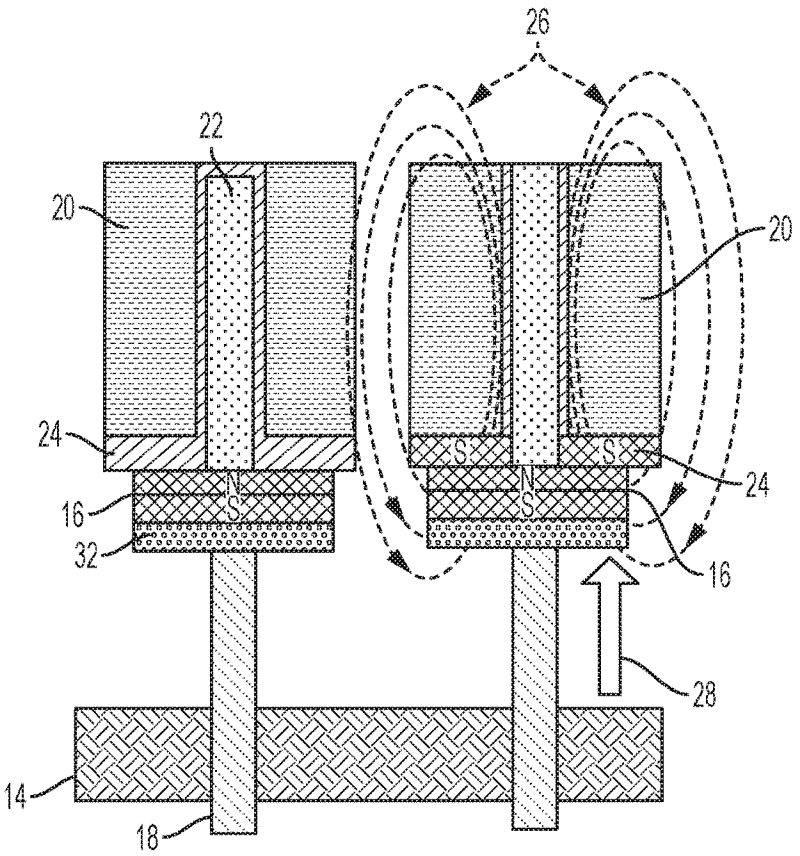
FIG. 5 is a functional illustration of the modified sliding camshaft actuator having an air gap layer disposed between the magnet and the pin stop plate being repelled by the magnetic field force in accordance with aspects of an exemplary embodiment.

FIG. 4 is a functional illustration of a modified sliding camshaft actuator having an air gap layer 32 disposed between a pin stop plate 14 and a magnet 16 being repelled by the magnetic field force 28 in accordance with aspects of an exemplary embodiment is provided. The air gap layer 32 is formed of a non-ferrous material which essentially void of magnetic properties and thus the magnetic attraction force 30 between the magnet 16 and the pin stop plate 14 is substantially reduced. In such case, when the magnetic field generating coils 20 are caused to generate a reverse magnetic field 26, the retracting magnetic force 28 will now be strong enough to overcome the magnetic attraction 30 between the magnet 16 and the pin stop plate 14 and the actuator pin 18 will be moved back to the retracted position as illustrated in FIG. 5. As such, the addition of the creating an air gap between the magnet 16 and the pin stop plate 20 eliminates the need for removing the sliding camshaft actuator from the engine and manually retracting the actuator pin 18.

Figure 6:
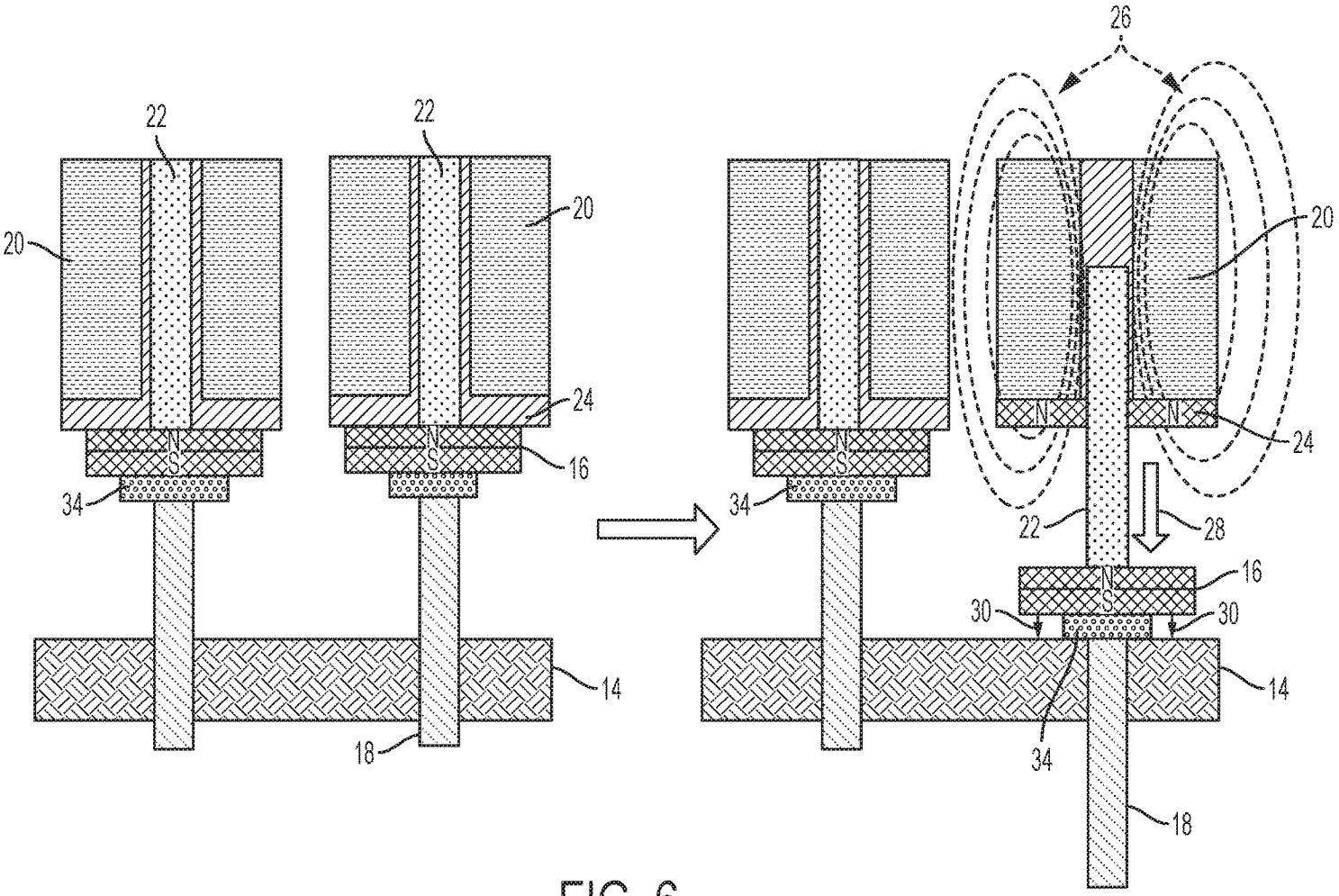
FIG. 6 is a functional illustration of a modified sliding camshaft actuator having a non-ferrous collar formed on the actuator pin to create an air gap in accordance with aspects of an exemplary embodiment.

Referring to FIG. 6, a functional illustration of a modified sliding camshaft actuator having a non-ferrous collar 34 formed on the actuator pin 18 to create an air gap in accordance with aspects of a second exemplary embodiment is provided. As described in the previous exemplary embodiment, the non-ferrous collar 34 is essentially void of magnetic properties and thus the magnetic attraction force 30 between the magnet 16 and the pin stop plate 14 is substantially reduced. Preferably, the non-ferrous material collar 34 is formed on the actuator pin 18 proximal to the magnet 16 to create the air gap that will allow for a retracting magnetic field force to overcome the magnetic field attracting force 30 between the magnet 16 and the pin stop plate 14.

Figure 7:
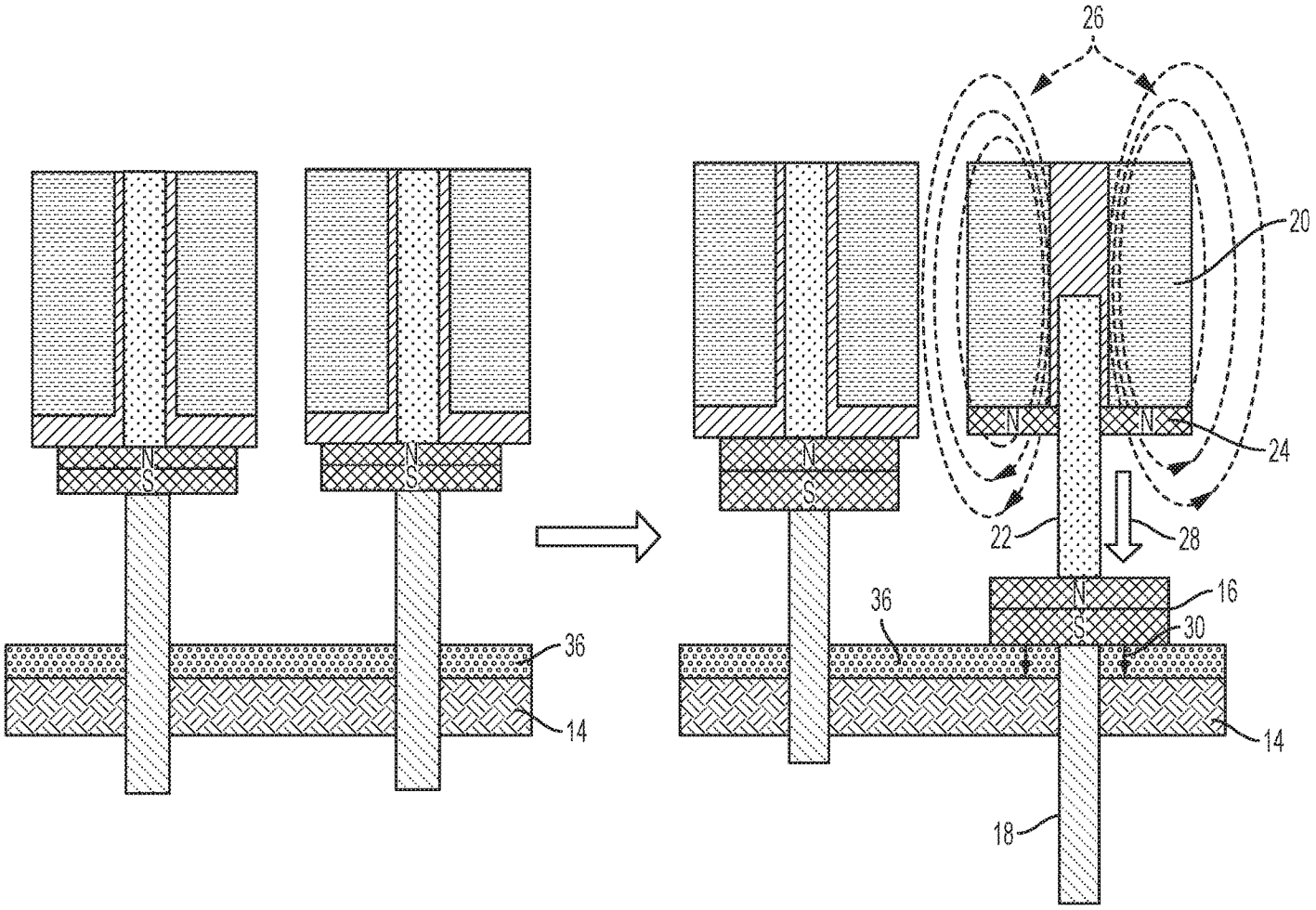
FIG. 7 is a functional illustration of a modified sliding camshaft actuator having a non-ferrous layer disposed on the pin stop plate to create an air gap in accordance with aspects of an exemplary embodiment.

FIG. 7 is a functional illustration of a modified sliding camshaft actuator having a non-ferrous layer 36 disposed on a top surface of the pin stop plate 14 to create an air gap in accordance with aspects of another exemplary embodiment. As in the previous embodiments, the non-ferrous layer 36 will provide the air gap that will allow for a retracting magnetic field force to overcome the reduced magnetic field attracting force 30 between the magnet 16 and the pin stop plate 14.

Figure 8:
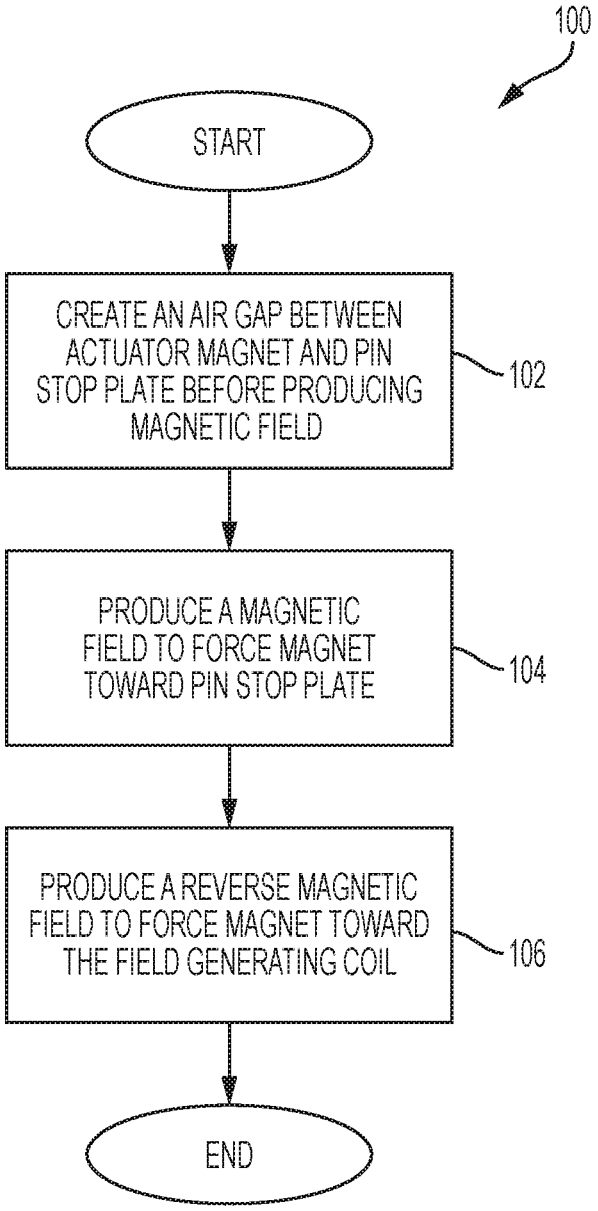
FIG. 8 is an illustration of an algorithm of the method of retracting an extended actuator pin of a sliding camshaft actuator as according to an exemplary embodiment.

Referring now to FIG. 8, an illustration of an algorithm 100 of the method of retracting an extended actuator pin of a sliding camshaft actuator as according to an exemplary embodiment is provided. The method begins at block 102 with creating an air gap between the actuator magnet and the pin stop plate before producing a magnetic field to force the magnet toward the pin stop plate. At block 104, the method continues with producing a magnetic field to force the magnet toward the pin stop plate to extend the actuator pin. At block 106, the method continues with producing a reverse magnetic field to force the magnet and the extended actuator pin toward the magnetic field generating coil such that the extended actuator pin is retracted.

The description of the invention is merely exemplary in nature and variations that do not depart from the gist of the invention are intended to be within the scope of the invention. Such variations are not to be regarded as a departure from the spirit and scope of the invention.

What is claimed is:

1. A method for retracting an extended actuator pin of a sliding camshaft actuator wherein the sliding camshaft actuator includes a housing having a pin stop plate, a magnet attached to the actuator pin disposed intermediate between a magnetic field generating coil and the pin stop plate wherein the magnetic field generating coil is operable to produce a magnetic field to force the magnet toward the pin stop plate to extend the actuator pin, the method comprising:

creating an air gap between the magnet and the pin stop plate before producing a magnetic field to force the magnet toward the pin stop plate;

producing the magnetic field to force the magnet toward the pin stop plate to extend the actuator pin; and producing a reverse magnetic field to force the magnet and the extended actuator pin toward the magnetic field generating coil.

2. The method of claim 1 wherein creating comprises attaching a non-ferrous material layer between the magnet and the pin stop plate.

3. The method of claim 2 wherein the non-ferrous material layer is disposed on the magnet.

4. The method of claim 2 wherein the non-ferrous material is disposed on the pin stop plate.

5. The method of claim 1 wherein creating further comprises forming a non-ferrous material collar on the actuator pin proximal to the magnet.

6. The method of claim 1 wherein producing a reverse magnetic field comprises reversing voltage to the magnetic field generating coil.

7. A method for retracting an extended actuator pin of a sliding camshaft actuator wherein the sliding camshaft actuator includes a housing having a pin stop plate, a magnet attached to the actuator pin disposed intermediate between a magnetic field generating coil and the pin stop plate wherein the magnetic field generating coil is operable to produce a magnetic field to force the magnet toward the pin stop plate to extend the actuator pin, the method comprising:

forming a non-ferrous material collar on the actuator pin proximal to the magnet to create an air gap before producing the magnetic field to force the magnet toward the pin stop plate;

producing the magnetic field to force the magnet toward the pin stop plate to extend the actuator pin; and producing a reverse magnetic field to force the magnet and the extended actuator pin toward the magnetic field generating coil.

8. The method of claim 7 wherein producing a reverse magnetic field comprises reversing voltage to the magnetic field generating coil.

9. A method for retracting an extended actuator pin of a sliding camshaft actuator wherein the sliding camshaft actuator includes a housing having a pin stop plate, a magnet attached to the actuator pin disposed intermediate between a magnetic field generating coil and the pin stop plate wherein the magnetic field generating coil is operable to produce a magnetic field to force the magnet toward the pin stop plate to extend the actuator pin, the method comprising:

forming a non-ferrous material collar on the actuator pin proximal to the magnet and attaching a non-ferrous material layer between the magnet and the pin stop plate to create an air gap before producing the magnetic field to force the magnet toward the pin stop plate;

producing the magnetic field to force the magnet toward the pin stop plate to extend the actuator pin; and producing a reverse magnetic field to force the magnet and the extended actuator pin toward the magnetic field generating coil.

10. The method of claim 9 wherein producing a reverse magnetic field comprises reversing voltage to the magnetic field generating coil.

* * * * *